US008596483B2

(12) United States Patent
Molnar et al.

(10) Patent No.: US 8,596,483 B2
(45) Date of Patent: Dec. 3, 2013

(54) ROTATABLE ACCESS CLOSURE ELEMENT

(75) Inventors: Pal M. Molnar, St. Clair Shores, MI (US); Steven J. Wille, Macomb, MI (US); Tim E. Droege, Macomb, MI (US)

(73) Assignee: Novo Motor Acoustic Systems Inc., Warren, MI (US)

( * ) Notice: Subject to any disclaimer, the term of this patent is extended or adjusted under 35 U.S.C. 154(b) by 214 days.

(21) Appl. No.: 12/930,642

(22) Filed: Jan. 11, 2011

(65) Prior Publication Data

US 2011/0168710 A1 Jul. 14, 2011

Related U.S. Application Data

(60) Provisional application No. 61/293,892, filed on Jan. 11, 2010.

(51) Int. Cl.
*B65D 41/06* (2006.01)

(52) U.S. Cl.
USPC ..... 220/300; 220/86.2; 220/302; 220/315; 220/784; 220/788; 220/DIG. 32; 220/DIG. 33

(58) Field of Classification Search
USPC ..... 220/86.2, 288, 293, 298, 300–302, 315, 220/DIG. 32, 33, 784, 788; 215/222, 230, 215/332, 43, 216; 206/459.5
See application file for complete search history.

(56) References Cited

U.S. PATENT DOCUMENTS

| | | | | |
|---|---|---|---|---|
| 3,815,776 | A * | 6/1974 | MacMillan | 220/288 |
| 3,986,634 | A * | 10/1976 | Smith et al. | 220/288 |
| 4,020,970 | A | 5/1977 | Koscik et al. | |
| 4,081,102 | A * | 3/1978 | Sakai | 220/DIG. 33 |
| 4,142,648 | A * | 3/1979 | Johnson et al. | 220/203.02 |
| 4,300,702 | A * | 11/1981 | Scharrer | 220/295 |
| 4,304,339 | A * | 12/1981 | Sakai et al. | 220/DIG. 33 |
| 4,339,055 | A * | 7/1982 | Hutzenlaub | 220/DIG. 33 |
| 4,453,388 | A * | 6/1984 | Baker et al. | 220/210 |
| 4,497,419 | A | 2/1985 | Reitzel | |
| 4,516,688 | A * | 5/1985 | Freeland | 220/293 |
| 4,583,653 | A * | 4/1986 | Minsky | 220/300 |
| 5,086,942 | A | 2/1992 | Merz et al. | |
| 5,086,943 | A | 2/1992 | Poskie | |
| 5,183,173 | A * | 2/1993 | Heckman | 220/203.07 |
| 5,325,981 | A | 7/1994 | Klomhaus et al. | |
| 5,511,653 | A * | 4/1996 | Ovadia | 206/6.1 |
| 5,636,607 | A | 6/1997 | Sattler et al. | |
| 5,680,954 | A | 10/1997 | Arnold et al. | |
| 5,797,511 | A | 8/1998 | Elsdon et al. | |
| 6,089,199 | A | 7/2000 | Lohr et al. | |
| 6,108,944 | A | 8/2000 | Savoie | |
| 6,682,257 | B1 | 1/2004 | Zappe | |
| 7,278,259 | B2 | 10/2007 | Schmeichel et al. | |
| 7,389,760 | B2 | 6/2008 | Fogolini | |
| 2003/0205578 | A1 * | 11/2003 | Newport | 220/304 |
| 2008/0169260 | A1 * | 7/2008 | Hansson et al. | 215/216 |

* cited by examiner

*Primary Examiner* — Mickey Yu
*Assistant Examiner* — Brijesh V. Patel
(74) *Attorney, Agent, or Firm* — James C. Eaves, Jr.; Brian W. Chellgren; Bingham Greenebaum Doll LLP

(57) ABSTRACT

The present invention relates to a closure for an aperture. More specifically, the present invention relates to a closure for an access aperture in a panel, such as a closure for an oil filter access aperture in an engine cover. The present invention comprises a single-piece rotatably-engageable access closure element having a plurality of tension arms and adapted to seal an access aperture having cutouts corresponding to each of the plurality of tension arms.

19 Claims, 5 Drawing Sheets

ROTATABLE ACCESS CLOSURE ELEMENT

This application claims the benefit of U.S. Provisional Patent Application Ser. No. 61/293,892, entitled ROTATABLE ACCESS CLOSURE ELEMENT, filed Jan. 11, 2010 to Pal Molnar, Steve Wille, and Tim Droege, and incorporated herein by reference.

BACKGROUND OF THE INVENTION

1. Field of the Invention

The present invention relates to a closure for an aperture. More specifically, the present invention relates to a closure for an access aperture in a panel, such as a closure for an oil filter access aperture in an engine cover. The present invention comprises a single-piece rotatably-engageable access closure element having a plurality of tension arms and adapted to seal an access aperture having cutouts corresponding to each of the plurality of tension arms.

2. Background of the Related Art

Modern automobiles often include engine covers in the engine compartment. One purpose of the engine cover is to reduce sound emitted by the engine. The engine cover partially encapsulates the engine, providing a measure of acoustic isolation.

In order to be most effective, an engine cover cannot have any opening of significant size. In the past, small openings for the oil dipstick or similar devices have been considered acceptable. However, technological advances in the field of engine development have driven more compact engine designs with oil filters commonly being moved to higher positions on the engine. In order to access the oil filter, there must be a relatively large aperture in the engine cover. Leaving this aperture as an uncovered access aperture compromises the structural integrity of the engine cover and deteriorates the isolation and encapsulation functions of the cover.

SUMMARY OF THE INVENTION

An access closure element for an oil filter aperture needs to equally fulfill several challenging requirements. In order to provide superior encapsulation, the access closure element needs to be rigid. In order to avoid generating any buzz, squeak and/or rattle, the access closure element needs to tightly fit the aperture. To simplify servicing the oil filter, the access closure element needs to be easy to install and remove with one hand and without any tools. For durability, it needs to maintain these functions throughout the vehicle lifetime, under all possible engine compartment temperatures. Finally, mass production of the access closure element needs to be simple and cost-efficient.

The single-piece rotatably-engageable access closure element described in this application fulfills the aforementioned design requirements while minimizing the complexity of the part. These and other advantages of one or more aspects of the present invention will become apparent from the following description and attached drawings.

In one embodiment, the present invention is an access closure element for use with an access aperture located in a panel, the access aperture having a plurality of cutouts and the panel having a mating slope located adjacent to each of the plurality of cutouts, the access closure element comprising: a cap having a cap diameter, a body descending from the cap, the body having a body diameter sized to fit within the access aperture, and wherein the cap diameter is greater than the body diameter, and a plurality of tension arms extending radially from the body to a distance less than the cap diameter, each of the plurality of tension arms including a tension jut, wherein the plurality of cutouts correspond to the geometry of the tension arms, and wherein the access closure element is configured to be positioned within the access aperture and rotatably transitioned from an open position to a closed position by sliding the tension jut over the mating slope. In this embodiment, the access closure element further comprising a bearing jut extending radially from the body and the mating slope further comprising an edge, wherein the access closure element is configured to be positioned within the access aperture and rotatably secured thereto by sliding the bearing jut to engage the edge.

In another embodiment, the present invention is a closure element for use with an aperture located in a panel, the aperture having a plurality of cutouts and the panel having a mating slope located adjacent to each of the plurality of cutouts, the closure element comprising: a substantially circular cap having a cap diameter, a substantially cylindrical body descending from the cap, the body having a body diameter sized to fit within the aperture, and wherein the cap diameter is greater than the body diameter, a rigid ribbing structure, and a plurality of tension arms extending radially from the body to a distance less than the cap diameter, each of the plurality of tension arms including a tension jut, wherein the plurality of cutouts correspond to the geometry of the tension arms, and wherein the closure element is configured to be positioned within the aperture and rotatably transitioned from an open position to a closed position by sliding the tension jut over the mating slope.

In a further embodiment, the present invention is a system for removably sealing an aperture in a panel comprising: (1) a closure element having a cap having a cap diameter, a body descending from the cap, the body having a body diameter sized to fit within the aperture, and wherein the cap diameter is greater than the body diameter, and a plurality of tension arms extending radially from the body, each of the plurality of tension arms including a tension jut and a hard-stop feature; and (2) a panel having an aperture including a plurality of cutouts corresponding to the geometry of the plurality of tension arms, and a plurality of mating slopes, one of the plurality of mating slopes adjacent to each of the cutouts, and each of the plurality of mating slopes including a stopping face; wherein the body of the closure element is adapted to be inserted into the aperture such that the positions of the plurality of tension arms correspond to the positions of the cutouts and the closure element is adapted to be rotated within the aperture to slide the plurality of tension juts each over one of the plurality of mating slopes until the stopping face contacts the hard-stop feature.

BRIEF DESCRIPTION OF THE DRAWINGS

A better understanding of the present invention will be had upon reference to the following description in conjunction with the accompanying drawings, wherein.

DETAILED DESCRIPTION OF THE INVENTION

Figure 1:
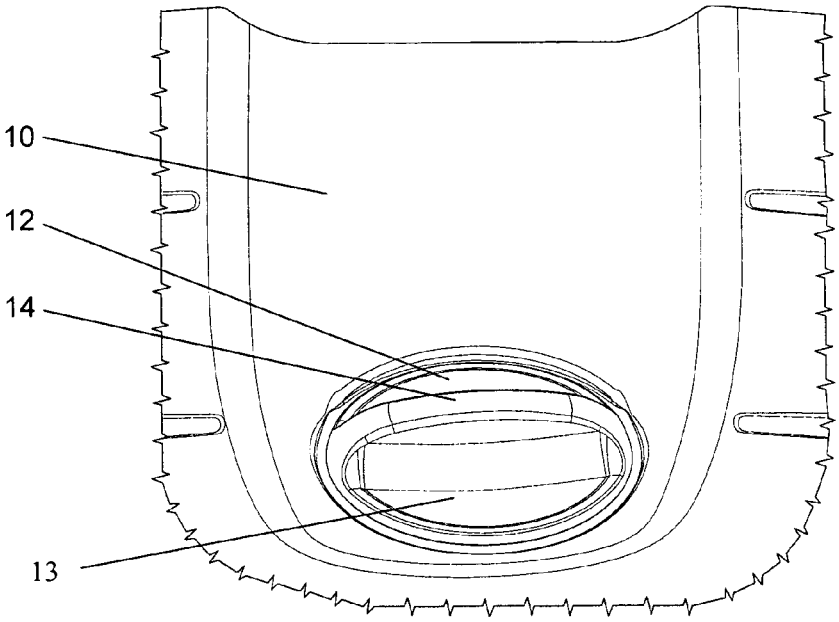
FIG. 1 is a top perspective view of a first embodiment of an access closure element installed in panel.

The present invention relates to a rotatable access closure element. While this invention is susceptible to embodiment in many different forms, there is shown in the drawings and will herein be described in detail specific embodiments, with the understanding that the present disclosure of such embodiments is to be considered as an example of the principles and not intended to limit the invention to the specific embodiments shown and described. For example, the description herein recites an access closure element used to cap an oil filter access aperture in an engine cover. The present invention contemplates use of access closure elements to cap engine cover apertures other than those for oil filters. Furthermore, the present invention contemplates use of an access closure element to cap an aperture in any type of panel, not only an aperture in an engine cover. In addition, terms such as "descending" and "sliding over" are used to describe the relationship between elements of the access closure element and the panel. It should be understood that the access closure element may be arranged at any orientation in relation to the panel. For example, if an access closure element is positioned at the underside of a panel, a "descending" element of the access closure element would spatially be extending upwards.

FIG. 1 shows the top view of a first embodiment of the present invention. A panel 10, such as an engine cover, has an access closure element 12. The access closure element 12 has a handle 14, allowing for the element 12 to be rotatably tightened and loosened with one hand, without the need of any tool.

Figure 2:
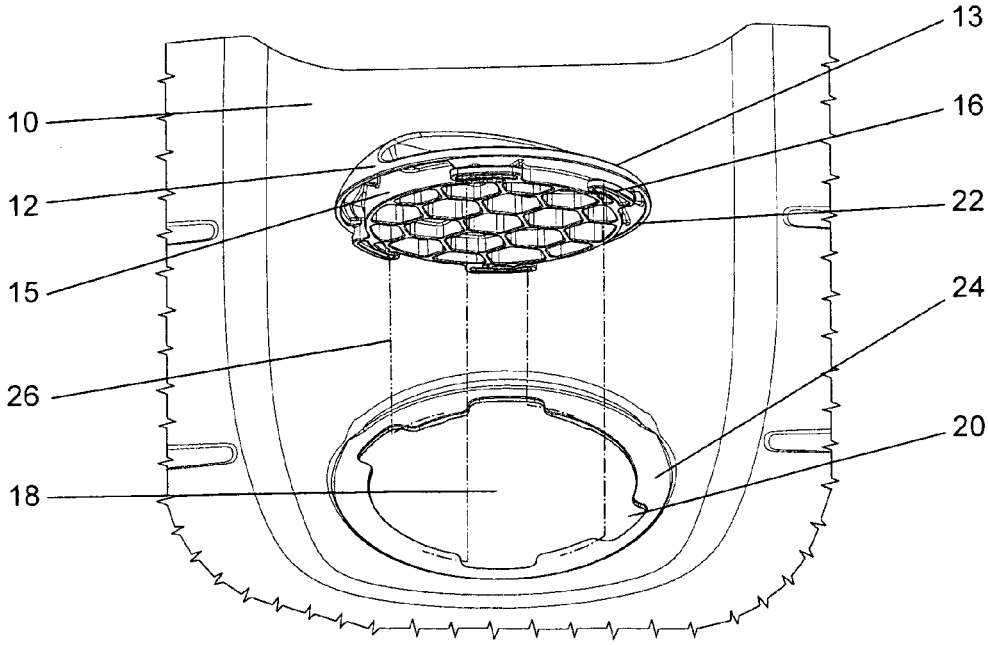
FIG. 2 is an exploded view of the first embodiment in which the underside of the access closure element is shown.

FIG. 2 shows the first embodiment in exploded view. The access closure element 12 comprises a substantially circular cap 13 and a substantially cylindrical body 15 descending therefrom. The diameter of the cap 13 is greater than the diameter of the body 15. A plurality of tension arms 16 extend from the circumference of the body 15 to a distance less than the diameter of the cap 13. Preferably, the cap 13, body 15, and plurality of tension arms 16 of the access closure element 12 are formed as a single piece, such as, for example, by an injection molding process.

The panel 10 has a substantially circular access aperture 18, sized to receive the body 15, but with a diameter less than that of the cap 13. The access aperture 18 has a plurality of cutouts 20, corresponding to the number and geometry of the plurality of tension arms 16. The cap 13 includes a sealing edge 22 designed to mate with a sealing surface 24 of the panel 10. Preferably, the sealing surface 24 extends circumferentially from the aperture 18 and the sealing edge 22 has a greater diameter than the aperture 18. The dotted and dashed lines of assembly path 26 show the method of assembling the part. The access closure element 12 is lowered into the access aperture 18, then rotated from an open position to a closed position.

Each of the figures depict a substantially circular closure element 12 and substantially circular aperture 18. In alternative embodiments, not shown, the closure element 12 may be oval-shaped or any other geometric shape. In such alternative embodiments, the aperture 18 is correspondingly shaped to receive the body 15 and allow it to be rotatably secured to the panel 10. In such embodiments, the term diameter, as used herein, refers to a straight line passing from side to side of a body of any shape, through its center.

Figure 3:
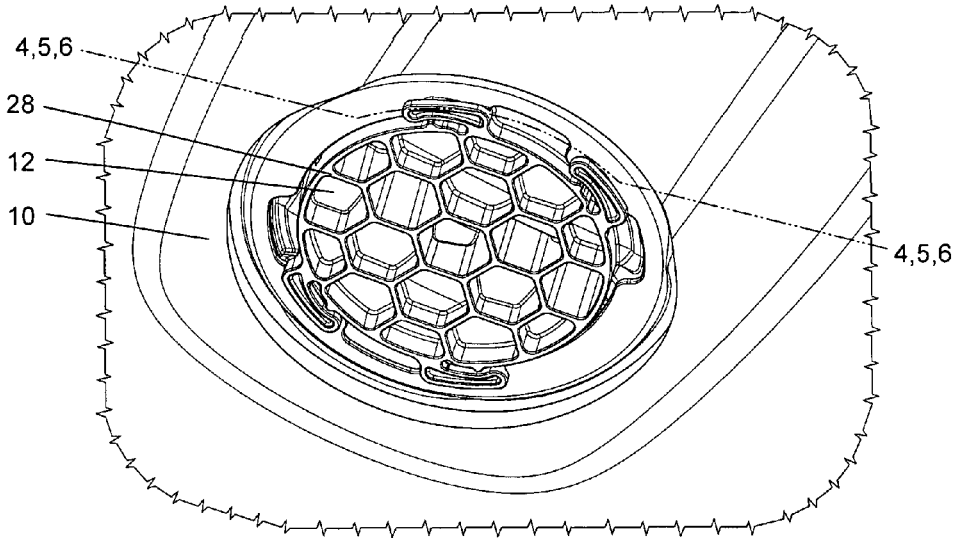
FIG. 3 is a bottom perspective view of the first embodiment in a closed position.

FIG. 3 shows a bottom view of the first embodiment in a closed position. In order to fulfill the above-mentioned rigidity and the acoustic isolation requirements, the access closure element 12 is equipped with a rigid ribbing structure 28. In the first embodiment, the rigid ribbing structure 28 is a plurality of short, rigid ribs arranged in a honeycomb pattern covering the substantially the entire bottom surface of the body 15. As shown in FIG. 3, the honeycomb pattern primarily includes hexagonal elements, with the circumferential elements truncated into trapezoidal or pentagonal shapes at the circumference of the body 15. In other embodiments, patterns other than a honeycomb of hexagons may be used. The rigid ribbing structure 28 requires sufficient rigidity to isolate vibrations in the access closure element 12, while individual ribs are preferably relatively thin for ease of molding and to minimize the weight of the access closure element 12. The exact width and length of each individual rib and the pattern of the rigid ribbing structure 28 may vary based on the size of the access closure element 12 and the amount of vibration which the access closure element 12 and panel 10 may be subject to. The height of each individual rib may vary based on the contouring of the cap 13. In this first embodiment, the height of each rib varies from about 7 mm to about 35 mm, based on the contouring of the cap 13. The majority of the ribs have a length of about 26 mm, while ribs contacting the circumference of the body 15 may be truncated. The width of each rib is about 3.7 mm adjacent to the cap 13, and narrows to about 2.5 mm as the rib extends away from the cap 13.

Figure 4A:
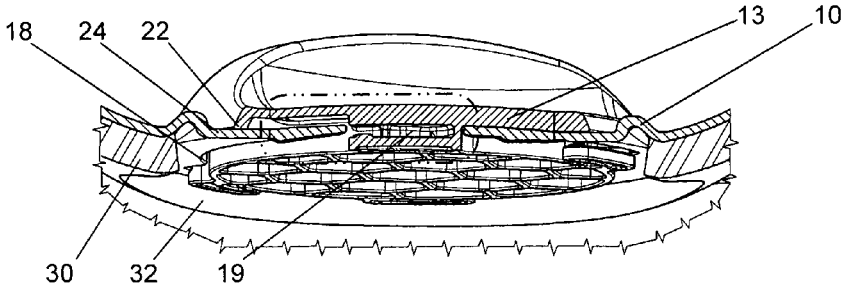
FIG. 4A is a cross-sectional view along line 4,5,6-4,5,6 of the first embodiment in an open position.
Figure 4B:
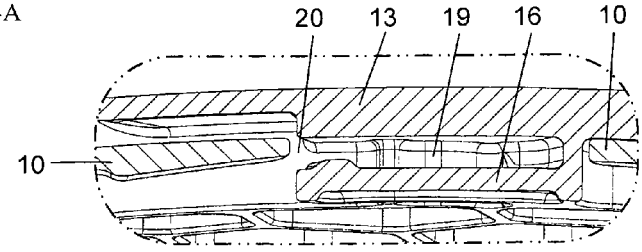
FIG. 4B is a detail view of FIG. 4A.

FIGS. 4A and 4B show cross-sectional views of the first embodiment in an open position. Here the access closure element 12 fits loosely in the access aperture 18, while each tension arm 16 is relaxed and fits loosely within each corresponding cutout 20. As shown in these figures, the tension arm 16, cap 13, and a hard-stop feature 42 connecting the tension arm 16 to the cap 13 cooperatively form a slot 19 adapted to receive a portion of the panel 10. The sealing edge 22 is juxtaposed against the sealing surface 24, at this point without any tension. The panel 10 may include an insulation layer 30, either with acoustic, thermal, or any other functionality, which necessarily includes a corresponding insulation cutout 32 with the same functionality as the access aperture 18.

Figure 5A:
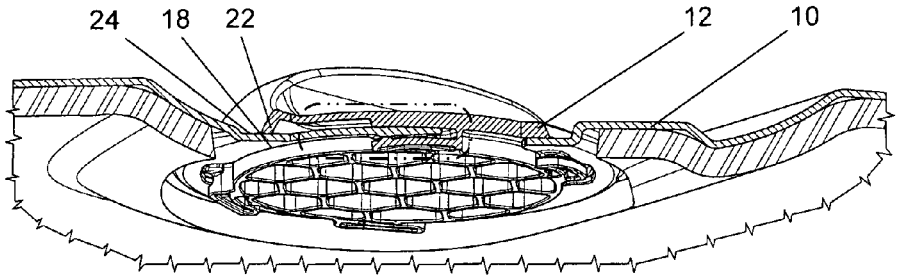
FIG. 5A is a cross-sectional view along line 4,5,6-4,5,6 of the first embodiment in a partially closed position.
Figure 5B:
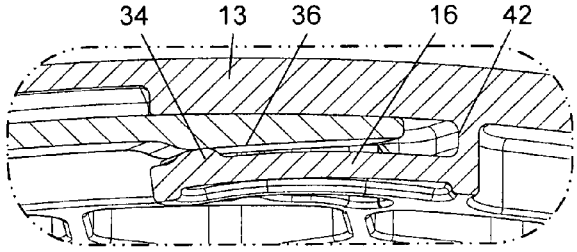
FIG. 5B is a detail view of FIG. 5A.

FIGS. 5A and 5B show cross-sectional views of the first embodiment in a partially closed position. A tension jut 34 projects from the side closest to the cap 13 of each of the plurality of tension arms 16. The tension juts 34 are designed to contact an opposing mating slope 36 of the panel 10. The opposing mating slope 36 is located adjacent to the cutout 20 corresponding to the tension arm 16. By rotating the access closure element 12 in the access aperture 18, the mating slope 36 is forced into the slot 19, gradually deflecting the tension jut 34 axially, while deforming the tension arm 16 helicoidally. During this process, the pressure between the sealing edge 22 and the sealing surface 24 also increases gradually, causing a friction torque counteracting the tightening torque.

The dimensions of all these features are predetermined to fulfill the above-mentioned requirements towards the tightening torque.

Figure 6A:
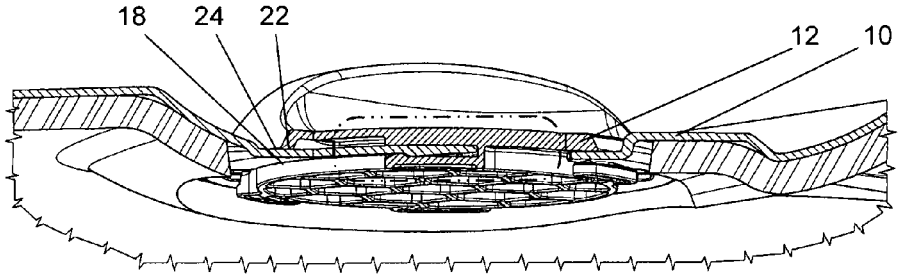
FIG. 6A is a cross-sectional view along line 4,5,6-4,5,6 of the first embodiment in a closed position.
Figure 6B:
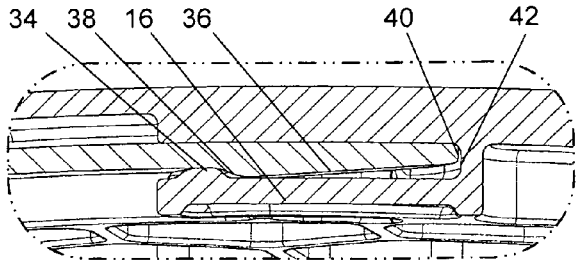
FIG. 6B is a detail view of FIG. 6A.

FIGS. 6A and 6B show cross-sectional views of the first embodiment in a fully closed and locked position. In this position, the tension jut 34 has been slid completely over the mating slope 36, and across the corresponding and adjacent divorcing slope 38, to find its final position. The tightening process pushes the stopping face 40 of the panel 10 against the hard-stop feature 42. The maximum rotation of the access closure element 12 in the aperture 18 is predetermined by the relative position of the stopping face 40 and hard-stop feature 42. Contact between the tension jut 34 and divorcing slope 38 prevents the access closure element 12 from freely returning to the open position. In this closed position, the deformation of the tension arms 16 has been reduced to a level that can be sustained throughout the lifetime of the parts. In order to avoid generating rattling noise, the amount of this remaining tension needs to compensate for the production tolerances, the plastic deformation commonly referred to as "creep," as well as the wear of both parts 10, 12. Also, this remaining tension needs to provide the acoustic sealing between the sealing edge 22 and sealing surface 24. In other embodiments of this invention, where airtight or liquid-tight sealing may be required, a labyrinth seal, gasket, or other suitable sealing element may be positioned between the sealing area 24 and sealing edge 22. In the tightening or closing process, the torque required to rotate the access closure element 12 into a closed position is mainly controlled by the angle of the mating slope 36. The loosening or opening process is exactly the opposite of the tightening process described above, where the loosening torque is mainly controlled by the angle of the divorcing slope 38.

In the first embodiment, the angle of the mating slope 36 is about 4.8 degrees and the angle of the divorcing slope 38 is about 30 degrees. In this embodiment, the axial load upon each tension jut 34 is about 3-5 Newtons ("N") during the tightening and loosening processes, and about 0.5-1.5 N when in the access closure element 12 is in the closed position. Tightening the closure element 12 by rotating it from the open to the closed position requires a torque of about 1.0-1.2 Newton meters ("Nm"). Loosening the element 12 by rotating it from the closed to the open position requires a torque of about 1.5-1.7 Nm. In alternatively embodiments where the panel 10 and closure element 12 are subject to greater vibration, a steeper mating slope 36 and divorcing slope 38 may be used to increase the torque required to rotate the closure element 12 to prevent unintentional rotation.

Figure 7A:
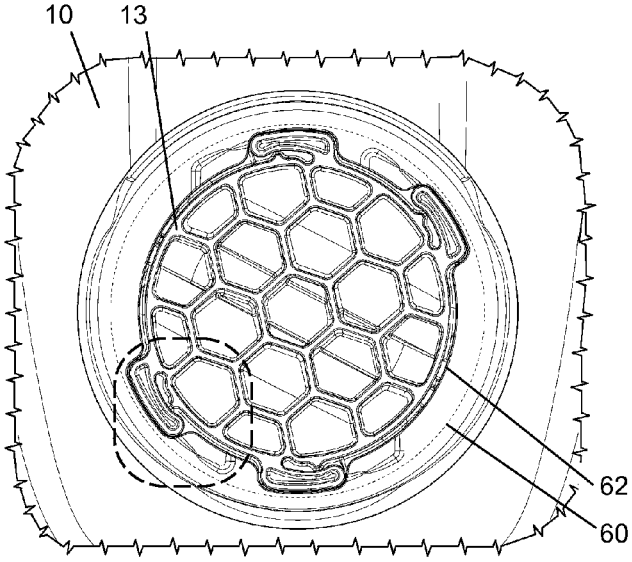
FIG. 7A is a bottom perspective view of the first embodiment in open position.
Figure 7B:
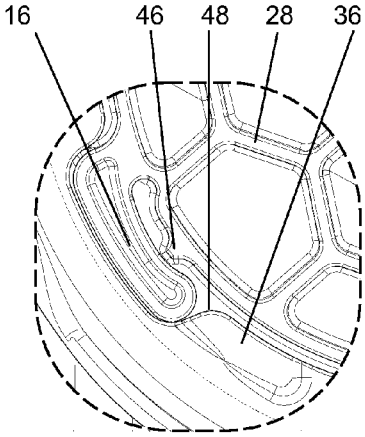
FIG. 7B is a detail view of FIG. 7A.
Figure 8A:
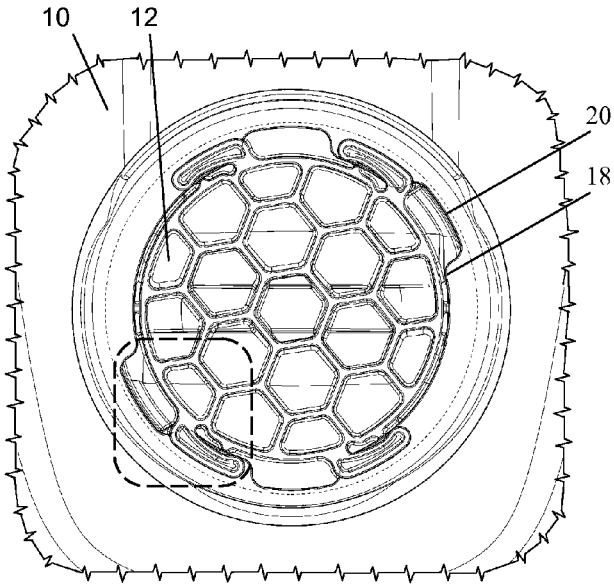
FIG. 8A is a bottom view of the first embodiment, in closed position.
Figure 8B:
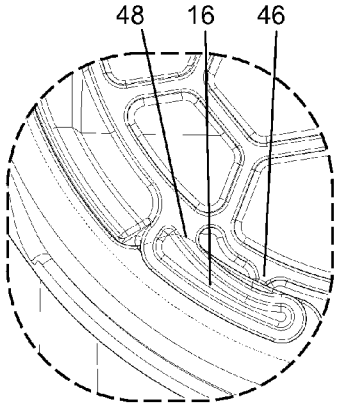
FIG. 8B is a detail view of FIG. 8A.

FIGS. 7A, 7B, 8A, and 8B show bottom views of the first embodiment, respectively in open and closed positions. FIG. 7A in particular illustrates that the cap diameter 60 is greater than the body diameter 62, and that the plurality of tension arms 16 extend radially from the body 13 to a distance less than the cap diameter 60. In this embodiment, the cap diameter 60 is about 135 mm, and the body diameter 62 is about 110 mm. The tension arms 16 extend out from the body, making the diameter of the body 15, including the tension arms 16, about 130 mm. The diameter of the aperture 18 is about 114 mm and about 131 mm at the locations of the cutouts 20.

The shape of the tension arms 16 is preferably optimized in accordance with well-known finite element analysis methods for bending stress to form a reliable and fatigue-resistant spring out of the same plastic material as the rest of the access closure element 12. This is particularly important in the area where it connects to the relatively stiff ribbing structure 28 of the access closure element 12. The axial deflection of the tension arm 16 increases the pressure between the sealing edge 22 and sealing surface 24, stabilizing the access closure element 12 in an axial direction.

A plurality of bearing juts 46 protrude from the body 15 and are sized to snugly engage the edge 48 of the mating slope 36 adjacent to the stopping face 40 when the access closure element 12 is in a closed position. Contact between the bearing jut 46 and the edge 48 of the mating slope 36 stabilizes the access closure element 12 in a radial direction, and also prevents any lateral movement of the access closure element 12. The plurality of bearing juts 46 are arranged to correspond to the positions of the cutouts 20 when the access closure element 12 is inserted into the aperture 18. During the tightening process, each bearing jut 46 engages the edge 48 of each mating slope 36, and slides along the edge 48 until the access closure element 12 reaches its secured final position when the stopping face 40 contacts the hard-stop feature 42.

Figure 9:
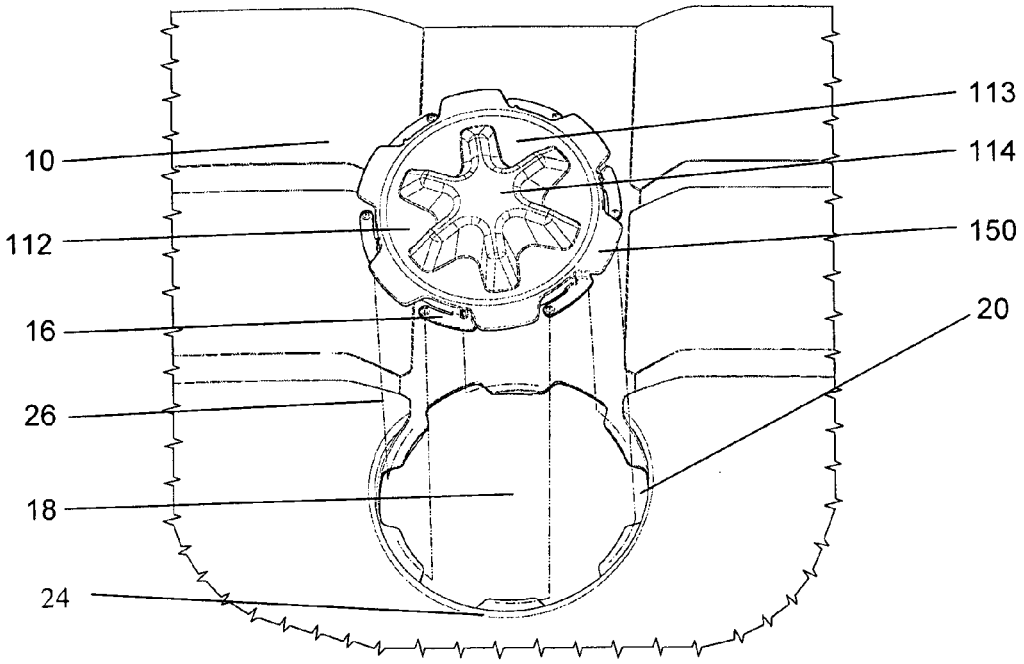
FIG. 9 is an exploded view of a second embodiment of an access closure element.

FIG. 9 shows a second embodiment of the present invention. In cases where the optimal acoustical sealing is not required and the appearance limitations are not significant, the closure element 112 can be simplified by avoiding any undercuts of the design. In this second embodiment, the cap 113 includes a plurality of covering flanges 150. When the closure element 112 is in a closed position, one of the plurality of covering flanges 150 will at least partially cover each one of the plurality of cutouts 20. In this embodiment, the diameter of the cap 113, including the flanges 150, is larger than the diameter of the aperture 18, including the cutouts 20, such that the flanges 150 contact the sealing surface 24. This embodiment also illustrates an alternative design for the handle 114. The design of the handle 14, 114 can be varied as desired or required for a particular application. In this embodiment, the access closure cap 112 includes six tension arms 16 instead of the four tension arms 16 included in the first embodiment.

Figure 10:
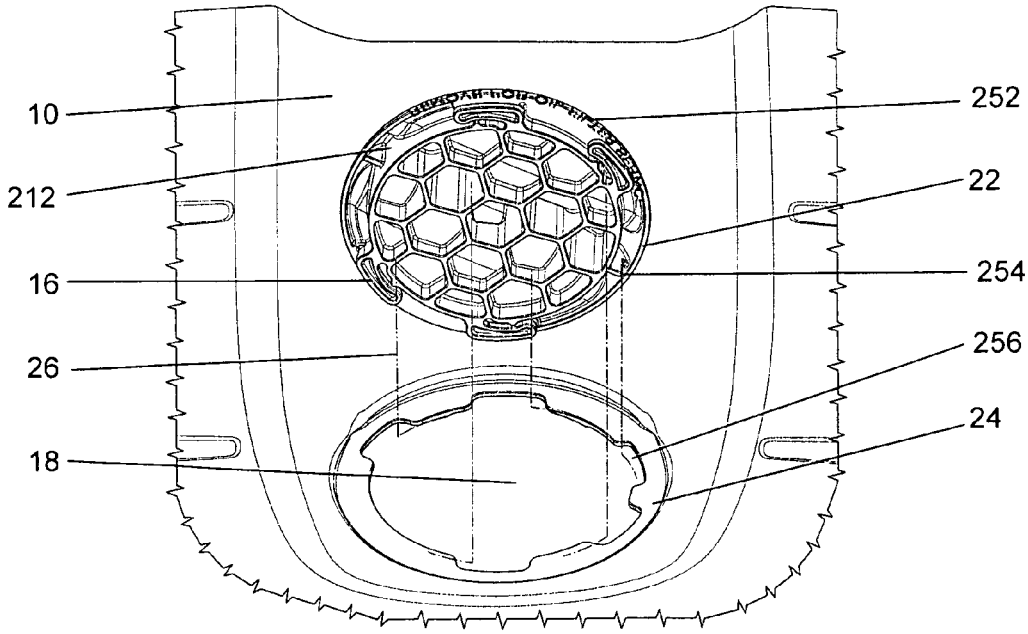
FIG. 10 is an exploded view of a third embodiment of an access closure element in which the underside of the access closure element is shown.

FIG. 10 shows a third embodiment of the present invention. In some cases, the orientation of the access closure element 212 may be important. For example, the access closure element 212 may include lettering 252 or a design which should be displayed at a particular orientation. One solution is to include a positioning tab 254 radially extending from the body 215 of the access closure element 212 as well as a corresponding positioning cutout 256 on the side of the access aperture 18 of the panel 10. There is no need for positioning tab 254 and cutout 256 to interlock, as their only function is to control the orientation of the access closure element 212. The positioning tab 254 may be a simple rectangular tab or other geometric shape which, in cooperation with the positioning cutout 256, controls the orientation of the access closure element 212, as the access closure element 212 will only fit within the access aperture 18 at an orientation where the positioning tab 254 is aligned to fit within the positioning cutout 256. An alternative solution is to locate the circumferential tension arms 16 and all the corresponding mating features asymmetrically (not shown here).

The foregoing detailed description is given primarily for clearness of understanding and no unnecessary limitations are to be understood therefrom for modifications can be made by those skilled in the art upon reading this disclosure and may be made without departing from the spirit of the invention and scope of the appended claims.

What is claimed is:

1. An access closure element for use with an access aperture located in a panel, the access aperture having a plurality of cutouts and the panel having a plurality of mating slopes, each located adjacent to one of the plurality of cutouts, the access closure element comprising:

a cap, a body descending from said cap, said body sized to fit within the access aperture, and wherein said cap is sized larger than said body, and a plurality of tension arms extending radially from said body to a distance less than the size of said cap, each of said plurality of tension arms including a tension jut projecting from said tension arm in the direction of said cap, wherein the geometry of said tension arms correspond to the plurality of cutouts, and wherein said access closure element is configured to be positioned within the access aperture and rotatably transitioned from an open position to a closed position by sliding said plurality of tension juts each over one of the plurality of mating slopes, and wherein said access closure element further comprising a bearing iut extending radially from said body, wherein said access closure element is configured to be positioned within the access aperture and rotatably secured thereto by sliding said bearing iut to engage an edge of the mating slope.

2. The access closure element of claim 1, the access closure element further comprising a rigid ribbing structure within said body.

3. The access closure element of claim 1, wherein each of the plurality of mating slopes includes a stopping face, wherein each of said plurality of tension arms includes a hard-stop feature, wherein the panel further comprises a plurality of divorcing slopes, each corresponding and adjacent to one of the plurality of mating slopes, and wherein said access closure element is configured to be positioned within the access aperture and rotatably secured thereto by sliding said plurality of tension juts each over one of the plurality of mating slopes and corresponding divorcing slopes until the plurality of stopping faces contact said plurality of hard-stop features.

4. The access closure element of claim 1, said cap further comprising a sealing edge shaped to mate with a sealing surface extending circumferentially from the access aperture.

5. The access closure element of claim 4, wherein said sealing edge is sized larger than the access aperture.

6. The access closure element of claim 1, wherein each of said tension juts are configured to axially deflect when contacting the mating slope during rotation of said access closure element from said open position to said closed position, and wherein said plurality of tension arms are configured to helicoidally deform when contacting the mating slope during rotation of said access closure element from said open position to said closed position.

7. The access closure element of claim 1, said access closure element further comprising a positioning tab, and the access aperture further comprising a positioning cutout corresponding to said positioning tab.

8. The access closure element of claim 1, wherein said access closure element is formed as a single piece.

9. The access closure element of claim 8, said access closure element manufactured using means for injection molding.

10. A closure element for use with an aperture located in a panel, the aperture having a plurality of cutouts and the panel having a mating slope located adjacent to each of the plurality of cutouts, the closure element comprising:

a substantially circular cap having a cap diameter, a substantially cylindrical body descending from said cap, said body having a body diameter sized to fit within the aperture, and wherein said cap diameter is greater than said body diameter, a rigid ribbing structure within said body, and a plurality of tension arms extending radially from said body to a distance less than said cap diameter, each of said plurality of tension arms including a tension jut projecting from said tension arm in the direction of said cap, wherein the geometry of said tension arms corresponds to the plurality of cutouts, and wherein said closure element is configured to be positioned within the aperture and rotatably transitioned from an open position to a closed position by sliding said plurality of tension juts each over one of the plurality of mating slopes, and wherein said closure element further comprising a bearing iut extending radially from said body and the mating slope further comprising an edge, wherein said closure element is configured to be positioned within said aperture and rotatable secured thereto by sliding said bearing iut to engage the edge.

11. The closure element of claim 10, wherein said rigid ribbing structure comprises a plurality of rigid ribs arranged in a pattern comprised predominantly of hexagonal elements.

12. The closure element of claim 10, wherein each of the plurality of mating slopes includes a stopping face, wherein each of said plurality of tension arms includes a hard-stop feature, wherein the panel further comprises a plurality of divorcing slopes, each corresponding and adjacent to one of the plurality of mating slopes, and wherein said closure element is configured to be positioned within the aperture and rotatably secured thereto by sliding said plurality of tension juts each over one of the plurality of mating slopes and corresponding divorcing slopes until the plurality of stopping faces contact said plurality of hard-stop features.

13. The closure element of claim 10, said cap further comprising a sealing edge shaped to mate with a sealing surface extending circumferentially from the aperture.

14. The closure element of claim 10, wherein each of said tension juts are configured to axially deflect when contacting the mating slope during rotation of said closure element from said open position to said closed position, and wherein said plurality of tension arms are configured to helicoidally deform when contacting the mating slope during rotation of said access closure element from said open position to said closed position.

15. The closure element of claim 10, said closure element further comprising a positioning tab corresponding to a positioning cutout in the aperture.

16. A system for removably sealing an aperture in a panel comprising:

a panel having an aperture including a plurality of cutouts, and a plurality of mating slopes, one of said plurality of mating slopes adjacent to each of said cutouts, and each of said plurality of mating slopes including a stopping face;

a closure element having a cap having a cap diameter, a body descending from said cap, said body having a body diameter sized to fit within said aperture, and wherein said cap diameter is greater than said body diameter, and a plurality of tension arms extending radially from said body, each of said plurality of tension arms including a tension jut projecting from said tension arm in the direction of said cap and a hard-stop feature; and wherein said plurality of cutouts correspond to the geometry of said plurality of tension arms; and wherein said body of said closure element is adapted to be inserted into said aperture such that the positions of said plurality of tension arms correspond to the positions of said cutouts and said closure element is adapted to be rotated within said aperture to slide said plurality of tension juts each over one of said plurality of mating slopes until said stopping face contacts said hard-stop feature, and wherein said closure element further comprises a plurality of bearing juts extending radially from said body, wherein each of said plurality of mating slopes further include an edge, and wherein said closure element is adapted to be rotated to bring each of said plurality of bearing juts into contact with one of said edges.

17. The system of claim 16, wherein said plurality of tension juts are configured to axially deflect when sliding over said plurality of mating slopes during rotation of said closure element, and wherein said plurality of tension arms are configured to helicoidally deform during rotation of said closure element.

18. The system of claim 16, wherein said panel includes a plurality of divorcing slopes, each corresponding and adjacent to one of said plurality of mating slopes.

19. The system of claim 18, wherein each of said plurality of divorcing slopes is adjacent to one of said plurality of mating slopes and opposite said stopping face of that mating slope.

* * * * *

UNITED STATES PATENT AND TRADEMARK OFFICE

CERTIFICATE OF CORRECTION

PATENT NO. : 8,596,483 B2
APPLICATION NO. : 12/930642
DATED : December 3, 2013
INVENTOR(S) : Pal Molnar, Steven Wille and Tim Droege It is certified that error appears in the above-identified patent and that said Letters Patent is hereby corrected as shown below:

In the Claims

Column 7, Line 19: the word "iut" should be replaced with --jut--

Column 7, Line 22: the word "iut" should be replaced with --jut--

Column 8, Line 19: the word "iut" should be replaced with --jut--

Column 8, Line 23: the word "iut" should be replaced with --jut--

Signed and Sealed this
Twenty-fourth Day of February, 2015

Michelle K. Lee

Michelle K. Lee
*Deputy Director of the United States Patent and Trademark Office*